US009493997B2

(12) United States Patent
Liu et al.

(10) Patent No.: US 9,493,997 B2
(45) Date of Patent: Nov. 15, 2016

(54) FLOATING CLAMPING DEVICE FOR INJECTION HEAD OF CONTINUOUS OIL PIPE

(75) Inventors: Dong Liu, Shandong (CN); Qingfeng Yu, Shandong (CN); Jilei Fang, Shandong (CN)

(73) Assignee: YANTAI JEREH OIL-FIELD SERVICES GROUP CO., LTD, Yantai, Shandong (CN)

( * ) Notice: Subject to any disclaimer, the term of this patent is extended or adjusted under 35 U.S.C. 154(b) by 596 days.

(21) Appl. No.: 14/004,957

(22) PCT Filed: Mar. 21, 2011

(86) PCT No.: PCT/CN2011/071988

§ 371 (c)(1),
(2), (4) Date: Sep. 13, 2013

(87) PCT Pub. No.: WO2012/126170

PCT Pub. Date: Sep. 27, 2012

(65) Prior Publication Data

US 2014/0000868 A1 Jan. 2, 2014

(30) Foreign Application Priority Data

Mar. 18, 2011 (CN) ..... 2011 1 0066259

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS

| | | | | |
|---|---|---|---|---|
| 5,727,753 A * | 3/1998 | Harris | B65H 23/038 | 226/191 |
| 6,347,664 B1 * | 2/2002 | Perio, Jr. | E21B 19/22 | 166/77.3 |
| 2011/0048694 A1 * | 3/2011 | Maschek, Jr. | E21B 19/22 | 166/77.3 |

* cited by examiner

*Primary Examiner* — Jennifer H Gay
*Assistant Examiner* — Steven MacDonald
(74) *Attorney, Agent, or Firm* — Andrew W. Chu; Craft Chu PLLC

(57) ABSTRACT

A floating clamping device for an injection head of a continuous oil pipe, including a drive sprocket, a transmission chain, a supporting plate, a pushing plate, clamping oil cylinders and a clamping assembly. At least two clamping oil cylinders are installed on the supporting plate fixedly. The pushing plate is fixed on the supporting plate through a pin shaft. The clamping assembly includes a saddle-shaped clamping block, a clamping block seat and rollers which are mounted on the clamping block seat. The clamping assembly is mounted on the transmission chain. A piston rod of the clamping oil cylinder is pressed on one face of the pushing plate, while the other face of the pushing plate is pressed on the rollers. The pushing plate has a simple structure and is convenient for maintenance; the clamping device has a compact structure and a reduced volume.

9 Claims, 3 Drawing Sheets

FLOATING CLAMPING DEVICE FOR INJECTION HEAD OF CONTINUOUS OIL PIPE

FIELD OF THE INVENTION

The present invention relates to the domain of petroleum drilling and production equipment, in particular to a floating clamping device for injection head of continuous oil pipe.

BACKGROUND OF THE INVENTION

Continuous oil pipe operation apparatuses are widely applied in different tasks in oil and gas field exploration and development. In recent years, as the usage and applied range of injection heads of continuous oil pipes were extended continuously, the operability and maintainability of injection heads of continuous oil pipes have become more and more important. A holding device for injector head of continuous oil pipe is a key component for continuous oil pipe operation apparatuses, in which the sprocket is driven by a hydraulic motor that can rotate in normal direction/reversed direction, and the continuous oil pipe is clamped by the clamping assembly between the chain links, so that the continuous oil pipe moves with the chain; thus, the continuous oil pipe can enter into and exit from the shaft.

At present, clamping devices that employ an integral pushing plate are a sort of commonly used injector head clamping devices, and have the following basic structure: the saddle-shaped clamping block is mounted on the chain, an integral pushing plate fixed to the supporting plate is arranged at inner side of the two chains respectively, and a plurality of wheel bearings are mounted on the integral pushing plate. The pushing plate is pushed by the hydraulic oil cylinders fixed to the supporting plate together, so that the wheel bearings on the integral pushing plate press the saddle-shaped clamping block and thereby clamp the continuous oil pipe. The structure described above have the following drawbacks in actual application: the pushing plate with bearings has poor maintainability, and is difficult to replace or repair; in addition, the clamping block seat that slides on the bearings may be worn easily and is difficult to replace; moreover, since the pushing plate is not fixed flexibly on the supporting plate, the pushing plate may be offset and seized, and therefore the clamping block is not stressed evenly and may be worn severely, causing damages to the oil pipe or machine; furthermore, since the pushing plate carries bearing bracket and bearings, the clamping device in such a structure is large in size, and even the clamping oil cylinders have to be mounted outside of the chain ring; consequently, the flexibility of the injector head is compromised.

SUMMARY OF THE INVENTION

The object of the present invention is to provide a floating clamping device for injector head of continuous oil pipe, which overcomes the drawbacks of the above-mentioned clamping devices in the prior art. To solve the problems described above, the present invention employs the following scheme: a floating clamping device for injection head of continuous oil pipe, comprising a drive sprocket, a transmission chain, a supporting plate, a pushing plate, clamping oil cylinders, and a clamping assembly, wherein, at least two clamping oil cylinders are installed on the supporting plate fixedly, the pushing plate is fixed on the supporting plate through a pin shaft, the clamping assembly comprises a saddle-shaped clamping bock, a clamping block seat, and rollers mounted on the clamping block seat, the clamping assembly is mounted on the transmission chain, a piston rod of the clamping oil cylinder is pressed on one side of the pushing plate, while the other side of the pushing plate is pressed on the rollers of the clamping block seat.

The present invention has the following beneficial effects: since a clamping assembly with rollers is used and the rollers utilize the pushing plate as a track to move, the clamping assembly can move steadily, and the structure of the pushing plate is very simple; in addition, since the rollers employ ceramic rolling shaft sleeves and don't have lubrication requirement, the injector head moves more reliably and is easy to service and operate; since the connection with the pushing plate is flexible, the pushing plate can float on the angle or position as the position of the continuous oil pipe changes, and therefore the continuous oil pipe is stressed uniformly and will not be hard extruded, and any damage to the machine can be avoided; moreover, since the pushing plate structure is simplified, the entire clamping device has compact structure and small size. In summary, the floating clamping device for injector head of continuous oil pipe can be used in injector head apparatuses for continuous oil pipes, and will have no deformation or abrasion resulted from uneven clamping force; thus, the oil tube clamping effect can be improved, and a technical problem of misalignment to the well mouth during the operation of injector head for continuous oil pipe in the prior art is solved.

Furthermore, on end of the pin shaft is connected to the pushing plate via a spherical plain bearing, and the other end of the pin shaft is mounted in the shaft sleeve of the supporting plate fixedly.

A beneficial effect of the above refined scheme is: with the spherical plain bearing, the degree of freedom of the pushing plate is increased, and the pushing plate can float more flexibly.

Furthermore, the rollers are ceramic rolling shaft sleeves.

A beneficial effect of the above refined scheme is: ceramic rolling shaft sleeves have advantages such as high wear resistance, high corrosion resistance, and lubrication-free, and are especially suitable for use in the working environment of injector heads.

Furthermore, the two ends of the pushing plate on the face that is connected to the rollers on the clamping block seat are in sloped bevel structure.

A beneficial effect of the above refined scheme is: the structure will not hinder the clamping assembly during movement, so that the ceramic rolling shaft sleeves of the clamping assembly can roll onto the pushing plate successfully.

Furthermore, the two ends of the pushing plate on the face that is connected to the rollers on the clamping block seat are in sloped bevel structure, and the two ends of the pushing plate on the face that is connected to the piston rods of the clamping oil cylinders are in sloped bevel structure.

Furthermore, one side of the saddle-shaped clamping block has a slot, the two side walls opposite to the slot have at least two hooking blocks respectively, and the hooking blocks on the two side walls are at positions corresponding to each other; the two sides of the clamping block seat have bosses corresponding to the hooking blocks of the clamping block, the clamping block are clamped to the clamping block seat via the hooking blocks and bosses, and the clamping block seat has stop blocks and bolt holes that are designed to confine the position of the clamping block.

A beneficial effect of the above refined scheme is: in such a structure, since stop block, hooking block, boss, and bolt are used for clamping and fixing on the clamping block seat, the clamping block can be replaced very conveniently;

Furthermore, clearance exists between the stop block and the clamping block and between the bolt hole and the clamping block.

A beneficial effect of the above refined scheme is: the clamping block can move with the continuous oil pipe as the position of the continuous oil pipe changes, so as to avoid hardness extrusion to the oil pipe. That function is the floating function of the clamping block.

Furthermore, the saddle-shaped clamping block has several grooves for clamping the continuous oil pipe, and the grooves are arranged perpendicular to the continuous oil pipe.

A beneficial effect of the above refined scheme is: better clamping effect can be attained.

Among the drawings: 1—drive sprocket, 2—supporting plate, 3—pushing plate, 4—clamping oil cylinder, 5—spherical plain bearing, 6—shaft sleeve, 7—pin shaft, 8—clamping block, 801—groove, 802—hooking block, 803—slot, 9—clamping block seat, 901—stop block, 902—boss, 903—bolt hole, 10—roller, 11—transmission chain, 12—continuous oil pipe, 13—tensioner sprocket.

DETAILED DESCRIPTION OF THE EMBODIMENTS

Hereunder the embodiments of the present invention will be detailed, with reference to the accompanying drawings.

Figure 1:
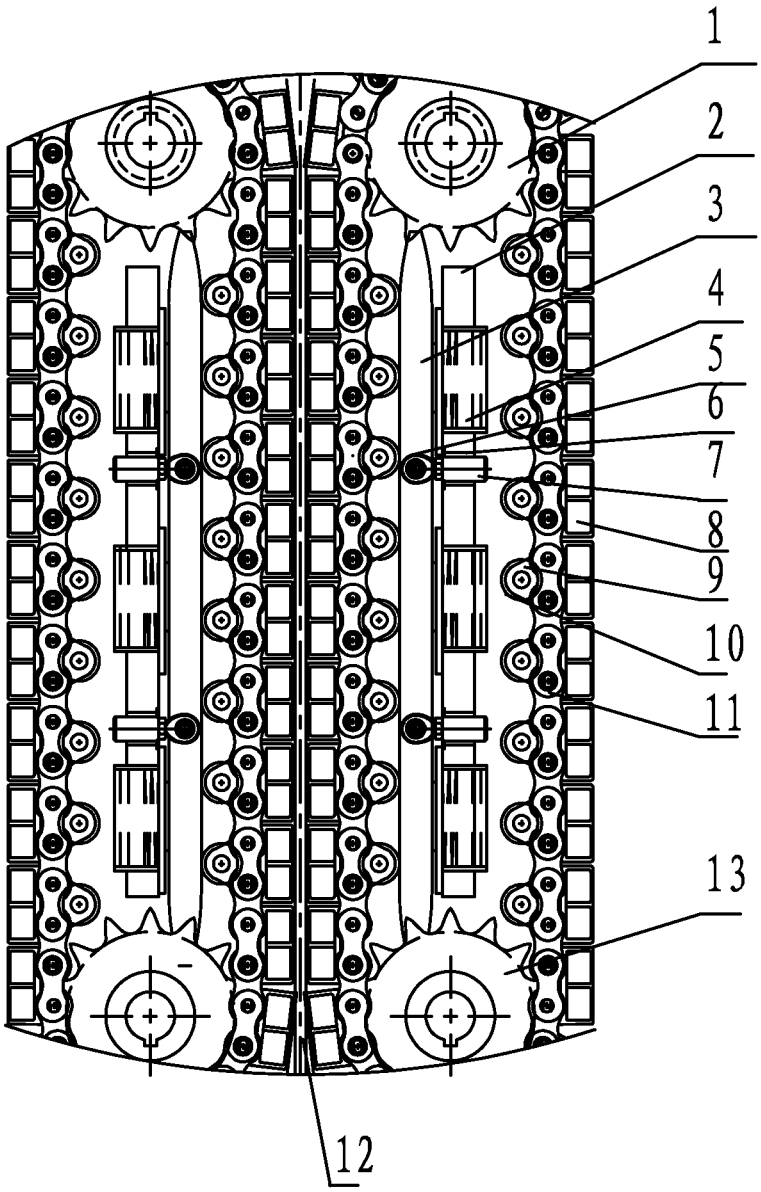
FIG. 1 is a front view of the floating clamping device disclosed in the present invention.
Figure 2:
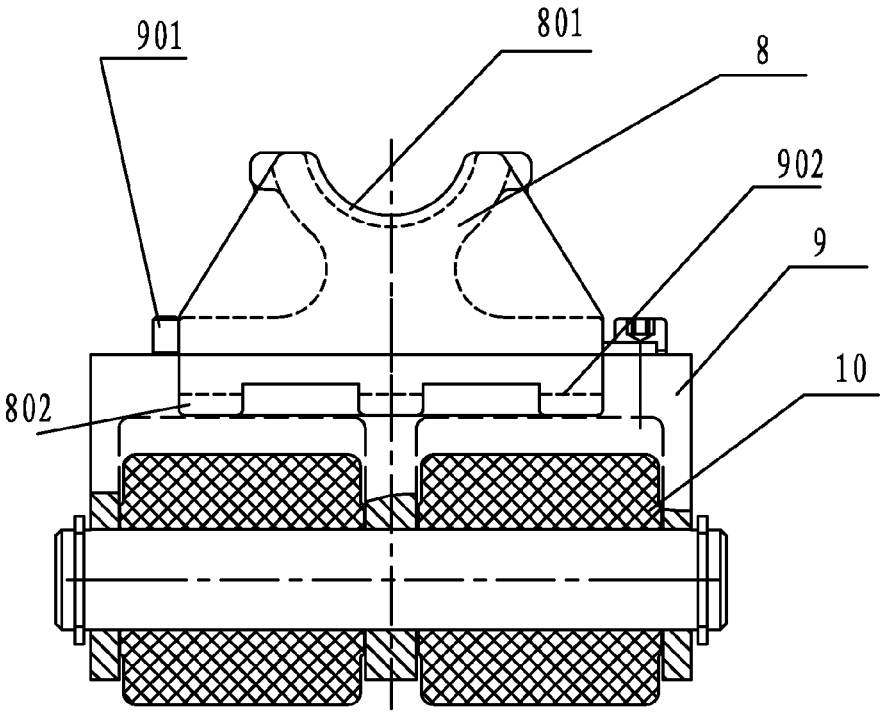
FIG. 2 is a schematic diagram of the clamping assembly on the floating clamping device disclosed in the present invention.
Figure 3:
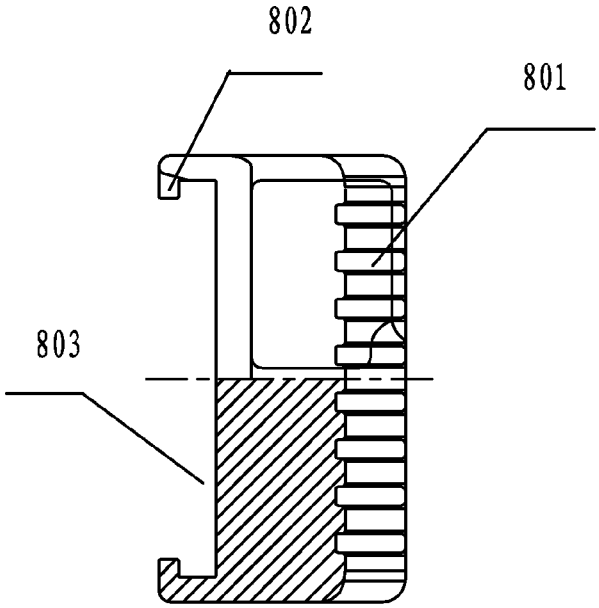
FIG. 3 is a sectional view of the clamping block on the floating clamping device disclosed in the present invention.
Figure 4:
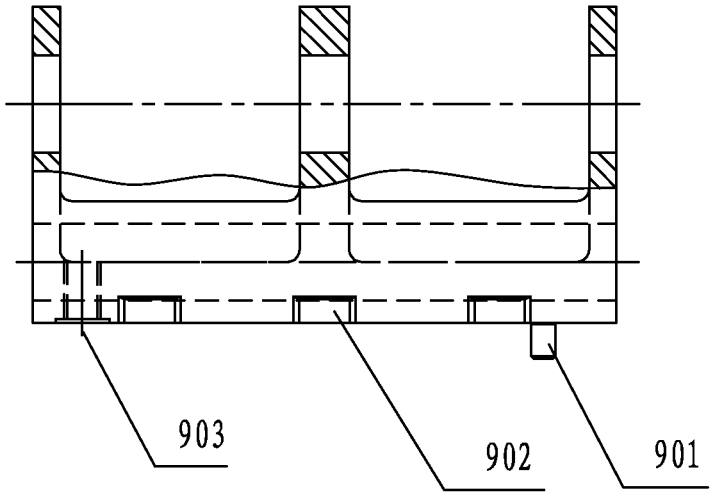
FIG. 4 is a sectional view of the clamping block seat on the floating clamping device disclosed in the present invention.
Figure 5:
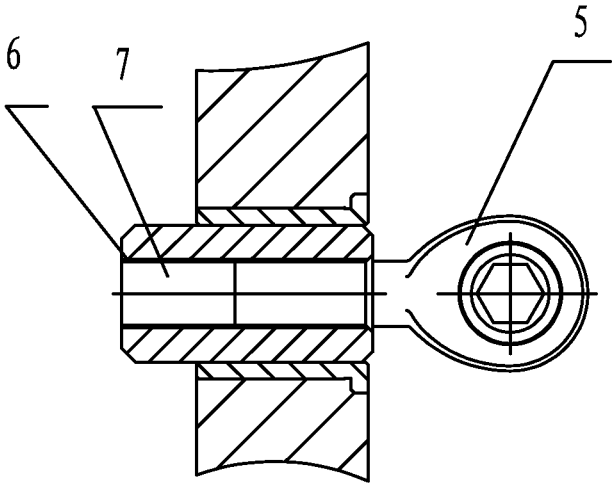
FIG. 5 is a schematic diagram of the connection between pushing plate and supporting plate on the floating clamping device disclosed in the present invention.

As shown in FIG. 1-5, the present invention provides a floating clamping device for injector head of continuous oil pipe, comprising a drive sprocket 1, a transmission chain 11, a supporting plate 2, a pushing plate 3, clamping oil cylinders 4, and a clamping assembly. Three clamping oil cylinders 4 are installed on the supporting plate 2 fixedly, the pushing plate 3 is fixed to the supporting plate 2 via a pin shaft 7, one end of the pin shaft is connected to the pushing plate 3 via a spherical plain bearing 5, and the other end of the pin shaft is mounted in a shaft sleeve 6 on the supporting plate 2 fixedly. With the spherical plain bearing 5, the degree of freedom of the pushing plate 3 is increased, and the pushing plate 3 floats more flexibly. The clamping assembly comprises a saddle-shaped clamping block 8, a clamping block seat 9, and rollers 10 mounted on the clamping block seat 9; the clamping block seat 9 has two through holes in parallel to the axial line of the rollers 10, and the clamping assembly is mounted on the transmission chain 11 via the two through holes on the clamping block seat 9. One face of the pushing plate 3 is pressed by the piston rods of the clamping oil cylinders 4, and the other face of the pushing plate 3 is pressed by the rollers on the clamping block seat 9.

The rollers 10 can be rolling shaft sleeves. In this embodiment, ceramic rolling shaft sleeves are used. Ceramic rolling shaft sleeves have advantages such as high wear resistance, high corrosion resistance, and lubrication-free, and are especially suitable for use in the working environment of injector heads.

The two ends of the pushing plate 3 on the face that is connected to the rollers 10 are in sloped bevel structure. That structure will not hinder the clamping assembly during movement, so that the ceramic rolling shaft sleeves of the clamping assembly can roll onto the pushing plate successfully.

One side of the saddle-shaped clamping bock 8 has a slot 803, the two side walls opposite to the slot 803 have at least three hooking blocks 802 respectively, and the hooking blocks 802 on the two side walls are at positions corresponding to each other; the two sides of the clamping block seat 9 have bosses 902 corresponding to the hooking blocks 802 of the clamping block 8, the clamping block 8 are clamped to the clamping block seat 9 via the hooking blocks 802 and bosses 902, and the clamping block seat 9 has stop blocks 901 and bolt holes 903 that are designed to confine the position of the clamping block 8. With that structure, the clamping block 8 can be replaced very conveniently to adapt to continuous oil pipes 12 in different diameters.

Since clearance exists between stop block 901 and clamping block 8 and between bolt hole 903 and clamping block 8, the clamping block 8 can move with the continuous oil pipe 12 as the position of the continuous oil pipe 12 changes, so as to avoid hard extrusion to the continuous oil pipe 12. That function is the floating function of the clamping block.

The saddle-shaped clamping block 8 has several grooves 801 that are perpendicular to the clamped continuous oil pipe 12. The clamping assembly and the transmission chain 11 are formed into an integral structure.

When the injector head is used, the drive sprocket 1 drives the transmission chain 11 to operate, and the tensioner sprocket 13 tensions up the transmission chain. One face of the pushing plate 3 is pressed by the piston rods of the clamping oil cylinder 4, and the other face of the pushing plate 3 is pressed by the rollers 10 on the clamping block seat 9; thus the clamping assembly for the continuous oil pipe 12 is clamped, the transmission chain drives the continuous oil pipe 12, the clamping assembly conveys the continuous oil pipe 12 forward, and the rollers 10 roll on the pushing plate 3. In case of any local abnormality of the clamped continuous oil pipe 12, the saddle-shaped clamping block 8 can be adjusted to left or right in the direction perpendicular to the continuous oil pipe 12, by means of the clearance between stop block 901 and clamping block 8 and clearance between bolt hole 903 and clamping block 8, and the pushing plate 3 can float automatically with the continuous oil pipe 12; thus, the flexibility of the injector head is improved, and hard extrusion to the continuous oil pipe can be avoided. While the present invention is described above in some preferred embodiments, the present invention is not limited to those preferred embodiments. Any modification, equivalent replacement, and improvement made without departing from the spirit and principle of the present invention shall be deemed as falling into the protected domain of the present invention.

What is claimed is:

1. A floating clamping device for injection head of continuous oil pipe, comprising a drive sprocket;

a transmission chain engaged with said drive sprocket;

a supporting plate positioned relative to said transmission chain;

a pushing plate attached to said supporting plate through a pin shaft;

at least two clamping oil cylinders fixedly attached to said supporting plate, each clamping oil cylinder having a piston rod; and a clamping assembly, being comprised of a saddle-shaped clamping block, a clamping block seat, and rollers mounted on said clamping block seat and being mounted on said transmission chain, wherein at least one piston rod presses on one face of said pushing plate, while at least one roller of said clamping assembly presses another face of said pushing plate, wherein each saddle-shaped clamping block is comprised of a saddle portion with at least one groove on a saddle side, two side walls on a slot side, and two hooking blocks on said slot side, said two side walls defining a slot, each side wall having a respective hooking block, wherein respective hooking blocks of said two side walls are aligned in position opposite each other, wherein each clamping block seat is comprised of a plurality of bosses corresponding to respective hooking blocks, at least one stop block, and at least one bolt hole, each hooking block being removeably engaged to a respective boss so as to clamp each clamping block seat to a respective saddle-shaped clamping block, the stop block being adjacent to one side of said bosses, the bolt hole being adjacent to an opposite side of said bosses, said respective saddle-shaped clamping block being movable between the stop block and the bolt hole, when each hooking block engages a respective boss.

2. The floating clamping device for injection head of continuous oil pipe according to claim 1, wherein said pin shaft has one end connected to said pushing plate via a spherical plain bearing and an opposite end fixedly attached to a shaft sleeve of said supporting plate.

3. The floating clamping device for injection head of continuous oil pipe according to claim 2, wherein said rollers are comprised of ceramic rolling shaft sleeves.

4. The floating clamping device for injection head of continuous oil pipe according to claim 1, wherein said rollers are comprised of ceramic rolling shaft sleeves.

5. The floating clamping device for injection head of continuous oil pipe according to claim 4, wherein said another face of said pushing plate has two ends, each end being a sloped bevel structure.

6. The floating clamping device for injection head of continuous oil pipe according to claim 5, wherein said one face of said pushing plate has two ends each end being a sloped bevel structure.

7. The floating clamping device for injection head of continuous oil pipe according to claim 1, wherein a distance between the stop block and the the bolt hole is greater than said respective saddle-shaped clamping block.

8. The floating clamping device for injection head of continuous oil pipe according to claim 7, wherein said saddle portion of a saddle-shaped clamping block is comprised of a plurality of grooves, said grooves being perpendicular to movement of said transmission chain.

9. The floating clamping device for injection head of continuous oil pipe according to claim 1, wherein said saddle portion of a saddle-shaped clamping block is comprised of a plurality of grooves, said grooves being perpendicular to movement of said transmission chain.

* * * * *